United States Patent [19]

Devillé et al.

[11] 4,431,944

[45] Feb. 14, 1984

[54] DELAY LINE HAVING COUPLED CAVITIES FOR A TRAVELING-WAVE TUBE AND A TRAVELING-WAVE TUBE EQUIPPED WITH SAID LINE

[75] Inventors: Christian Devillé; Francis Payen, both of Paris, France

[73] Assignee: Thomson-CSF, Paris, France

[21] Appl. No.: 302,569

[22] Filed: Sep. 15, 1981

[30] Foreign Application Priority Data

Sep. 19, 1980 [FR] France ..... 80 20216

[51] Int. Cl.[3] ..... H01J 25/34

[52] U.S. Cl. ..... 315/3.6; 315/39.3; 330/43; 333/152

[58] Field of Search ..... 315/3.6, 3.5, 39.3; 330/43; 333/152

[56] References Cited

U.S. PATENT DOCUMENTS

| | | | |
|---|---|---|---|
| 2,922,920 | 1/1960 | Convert | 315/3.6 |
| 3,068,425 | 12/1962 | Le Boutet et al. | 315/3.6 X |
| 3,274,428 | 9/1966 | Harris | 315/3.6 |
| 3,571,651 | 3/1971 | Wilbur | 315/3.6 |
| 3,846,664 | 11/1974 | King et al. | 315/3.6 |
| 3,876,902 | 4/1975 | Gross | 315/3.6 |
| 4,053,810 | 10/1977 | James | 315/3.6 |
| 4,147,956 | 4/1979 | Horigome et al. | 315/3.6 |
| 4,158,154 | 6/1979 | Gross | 315/3.6 |
| 4,315,194 | 2/1982 | Connolly | 315/3.6 |

*Primary Examiner*—Saxfield Chatmon, Jr.
*Attorney, Agent, or Firm*—Roland Plottel

[57] ABSTRACT

In the last section of a delay line having coupled cavities for a traveling-wave tube, the following parameters are progressively increased in the direction of propagation of the electron beam: the diameter of the opening provided for the passage of the electron beam, thus making it possible to ensure better transmission of the beam and consequently to ensure higher efficiency as well as lower heat build-up; the ratio $(D_2-D_1)/2$ of the cavity nozzles; and the thickness of the walls which are common to two adjacent cavities.

3 Claims, 3 Drawing Figures

Figure 2:
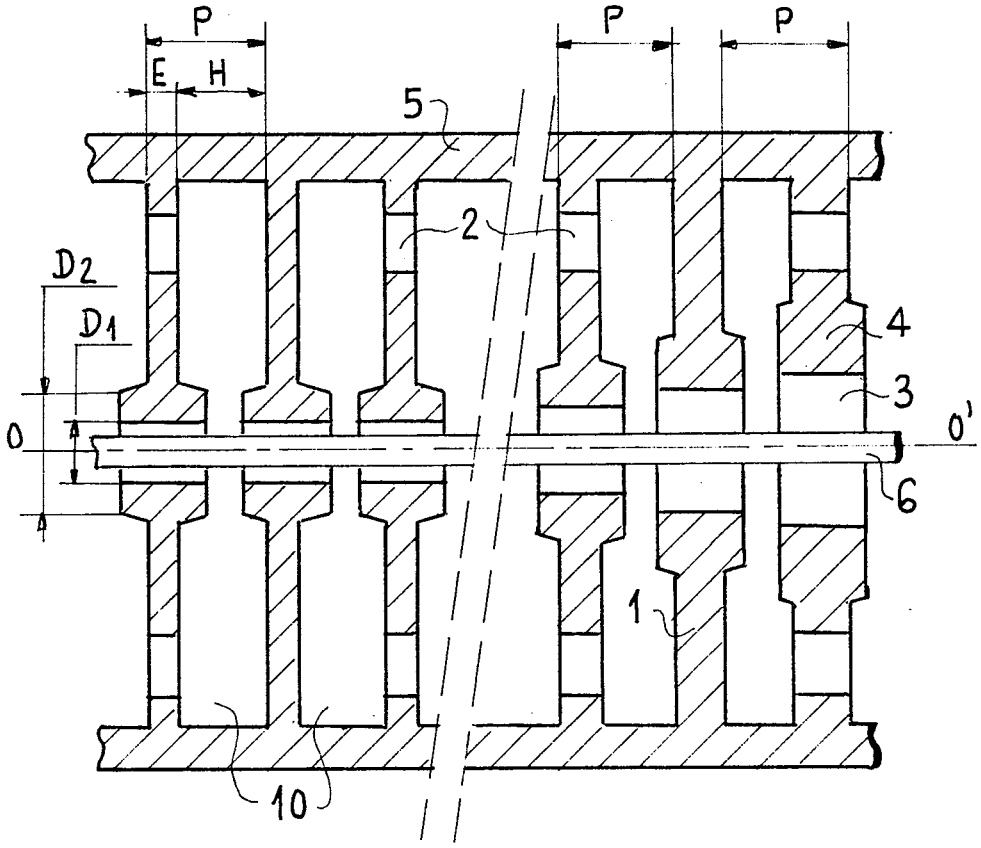

FIG_1-a "PRIOR ART"
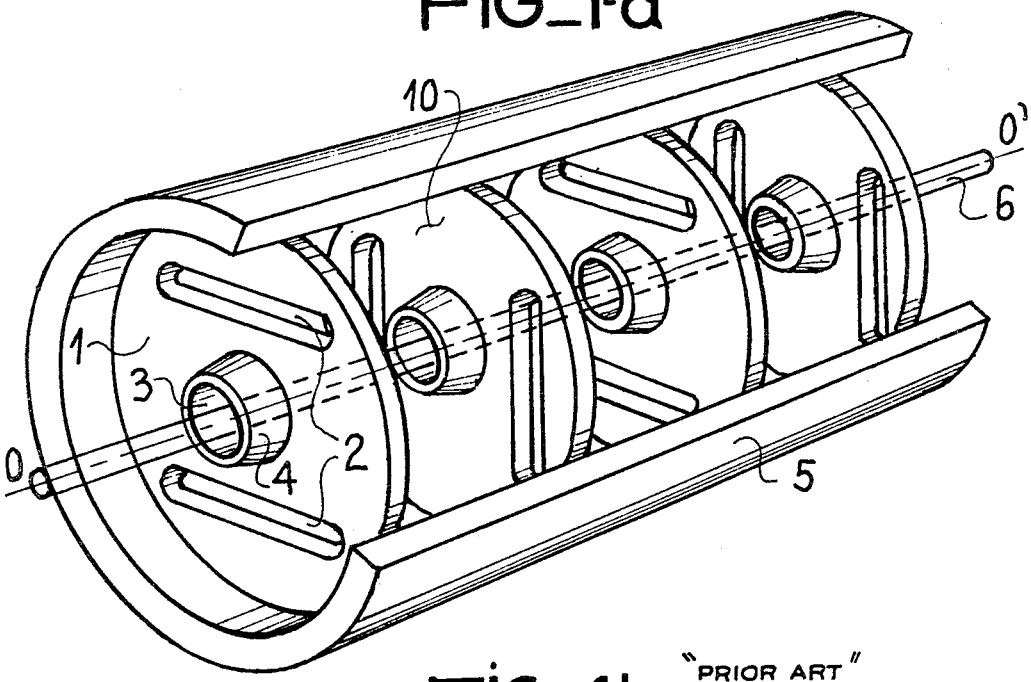
FIG_1-b "PRIOR ART"
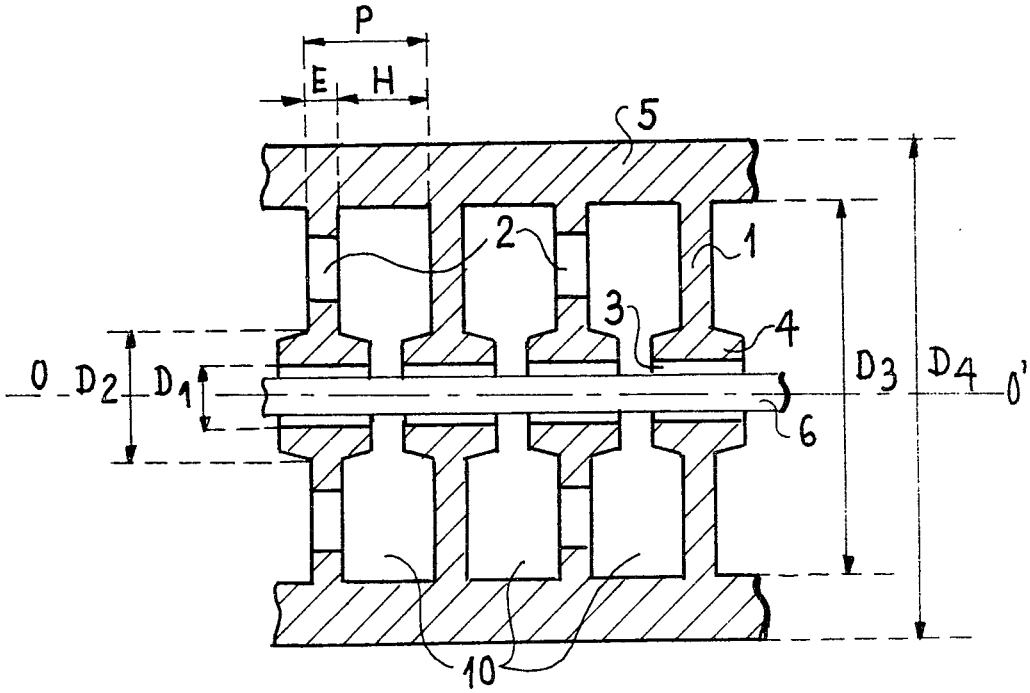

DELAY LINE HAVING COUPLED CAVITIES FOR A TRAVELING-WAVE TUBE AND A TRAVELING-WAVE TUBE EQUIPPED WITH SAID LINE

This invention relates to coupled-cavity delay lines for traveling-wave tubes as well as to microwave tubes equipped with lines of this type.

Coupled-cavity delay lines are more especially employed in traveling-wave tubes in which they produce an interaction between an electron beam which passes along the axis of the line and an electromagnetic wave which travels along the line. When conditions of synchronism of the wave and of the beam are satisfied, the electrons impart energy to the electromagnetic wave.

Coupled-cavity delay lines are constituted by a series of cavity resonators separated from each other by walls in which are pierced at least one opening which provides a coupling between cavities and an opening through which the electron beam passes, said beam being focused along the axis of the line.

With this type of line, it is an advantage to obtain high energy conversion efficiency, more particularly in the case of a traveling-wave tube having a high mean power. High conversion efficiency is usually obtained with a high coupling impedance between the beam and the line.

In the case of periodic lines having coupled cavities, this coupling impedance is proportional to the product of the quotient $V\phi/Vg$ ($V\phi$=phase velocity of the space harmonic with which the beam interacts; $V_g$=group velocity of the electromagnetic wave) and the quotient R/Q of the cavity.

R=shunt resistance of the cavity

Q=quality factor (Q factor).

A high coupling impedance results in a high value of the quotient $V\phi/V_g$, thus producing a dispersive line and a small passband, and/or in a high value of the quotient R/Q, which in turn results in low thermal resistance.

In point of fact, in the case of a traveling-wave tube having high interaction efficiency, the electron beam is highly disturbed, particularly in the final portion of the delay line in which the amplitude of the microwave voltage between cavity nozzles becomes a high fraction of the acceleration voltage which has given the electrons their initial velocity.

This disturbance results in defocusing of the beam and in intense electron bombardment of the cavity nozzles which consequently undergo a temperature rise, all the more so when these zones have high thermal resistance as in the instance under consideration.

This temperature rise limits the mean power which the traveling-wave tube is capable of delivering.

It may be endeavored to raise this mean power limit by circulating a coolant fluid within ducts pierced in the partition-wall between cavities. This solution involves a technological complication in the fabrication of the structure.

Thus a traveling-wave tube equipped with a coupled-cavity delay line as designed in accordance with the prior art will have high interaction efficiency at the expense either of the amplification band which will be small compared with the value which it is possible to attain with this type of line or of the mean power which the traveling-wave tube is capable of providing.

The present invention relates to a coupled-cavity delay line having enhanced thermal resistance and having conversion efficiency which is as high as that of coupled-cavity lines of the prior art without any reduction of the amplification band.

In contrast to the prior art, this improvement is obtained by means of a progressive reduction of the coupling impedance in the final portion of the delay line of the traveling-wave tube.

This reduction of the coupling impedance is mainly obtained by progressively reducing the R/Q ratio of the cavities. In order to maintain an equally high value of conversion efficiency in spite of the reduction of coupling impedance, there must necessarily be employed in conjunction with the progressive reduction of the coupling impedance a computer-calculated variation of the time-delay ratio $C/V\phi$ of the line as a function of the abscissa z of the line, where:

C is the velocity of light $V\phi$ is the phase velocity of the space harmonic with which the beam interacts.

The present invention relates to a delay line having coupled cavities of reentrant shape limited externally by a cylindrical wall whose axis coincides with the axis along which the electron beam of the tube is propagated, said cavities being limited laterally by walls perpendicular to said axis, each wall being common to two cavities. Said walls are pierced by at least one coupling opening between cavities and the center of each wall has an opening surrounded by a collar having the same axis and forming the reentrant portion of the cavity. The delay line is distinguished by the fact that at least one of the dimensions of the elements constituting said cavities increases in the direction of propagation of the electron beam.

Other features of the invention will be more apparent upon consideration of the following description and accompanying drawings, wherein:

FIG. 1*a* is a view in perspective showing a delay line with coupled cavities in accordance with the prior art;

FIG. 1*b* is a transverse sectional view of a delay line with coupled cavities in accordance with the prior art;

FIG. 2 is a transverse sectional view of a delay line having coupled cavities in accordance with the invention.

The view in perspective of FIG. 1*a* shows a coupled-cavity delay line in accordance with the prior art.

The delay line shown in FIG. 1*a* is provided with disks 1 aligned in parallel relation along a common axis 0—0' which coincides with the axis of propagation of the electron beam. Said disks form the wall which is common to two adjacent cavities 10.

Each disk is pierced on the one hand by two coupling openings 2 between cavities, said openings being symmetrical with respect to the axis of the line 0—0'. Each disk is pierced on the other hand by an opening 3 through which the electron beam 6 is intended to pass, said opening being generally circular and located at the center of the disk. The opening 3 is surrounded by a collar 4 having the same axis and designated as a cavity nozzle.

The cavities 10 are three in number in the figure and limited by a cylindrical wall 5.

FIG. 1*b* is a transverse sectional view of the coupled-cavity delay line of FIG. 1*a*. The geometrical parameters of the delay line as indicated in FIG. 1*b* are as follows:

$D_1$: the internal diameter of the collar 4;

$D_2$: the external diameter of said collars at the level of their junction with the disks 1;

$D_3$ and $D_4$: the internal and external diameters of the cylindrical wall which surrounds the cavities;

E: the thickness of the disks 1;

H: the width of the cavities;

the sum E+H being equal to the pitch P of the delay line.

FIG. 2 is a transverse sectional view of a coupled-cavity delay line in accordance with the invention.

In the last section or so-called output line of the coupled-cavity delay line in accordance with the invention, provision is made in the direction of propagation of the electron beam for a progressive increase in certain parameters of the delay line, namely as follows:

the diameter $D_1$ of the opening provided for the passage of the electron beam, thus making it possible to ensure better transmission of the beam and consequently to ensure higher efficiency together with lower heat buildup of the line;

the ratio $(D_2-D_1)/2$ of the cavity nozzles;

the thickness E of the walls which are common to two cavities.

Another novel feature of the present invention lies in the fact that, since extraction and transfer of the microwave energy from the beam to the useful load are carried out with an output section having a coupling impedance of decreasing value, there is less dispersion of electron velocities and focusing of the beam is facilitated. This factor represents an additional contribution to the mean power capacity which a travelling-wave tube is capable of providing.

Furthermore, the fact that the structure is made less dispersive not only has the effect of reducing the coupling impedance but also of increasing the passband. The arrangements contemplated by the present invention consequently tend towards an increase in width of the amplification band, which constitutes one of the most advantageous characteristics of traveling-wave tubes.

The invention applies generally to the production of high power levels with a wide passband and with high efficiency in the field of microwaves, especially centimetric waves.

What is claimed is:

1. A delay line for a traveling-wave tube having coupled cavities of reentrant shape limited externally by a cylindrical wall whose axis coincides with the axis along which the electron beam of the tube is propagated, said cavities being limited laterally by walls perpendicular to said axis, each wall being common to two cavities, alternate walls being pierced by at least one coupling opening between cavities and by a central opening surrounded by a collar having the same axis and forming the reentrant portion of the cavity, wherein the delay line comprises in its last section, in conjunction with a progressive reduction of the coupling impedance of the line, a variation of the time-delay ratio of the line as a function of the length of the line, said coupling impedance of decreasing value being obtained by a progressive increase in the direction of propagation of the electron beam of the internal diameter $D_1$ of the collars and of the ratio $(D_2-D_1)/2$, where $D_1$ is the internal diameter of the collars and $D_2$ the external diameter of said collars.

2. A delay line for a traveling-wave tube according to claim 1, wherein said coupling impedance of decreasing value is obtained by a progressive increase in the direction of propagation of the electron beam of the thickness of the walls which are common to two cavities.

3. A traveling-wave tube and especially an amplifier comprising means for producing an electron beam and for causing propagation of said beam towards a beam collector, and a delay line placed along the path of said beam, the electromagnetic waves which interact with the beam during operation being propagated along said delay line, wherein the delay line is a line according to claim 1.

* * * * *